US007988131B1

(12) United States Patent
Carder

(10) Patent No.: US 7,988,131 B1
(45) Date of Patent: Aug. 2, 2011

(54) ELECTRIC SCISSOR JACK APPARATUS

(76) Inventor: Leo F. Carder, Cumberland, MD (US)

( * ) Notice: Subject to any disclaimer, the term of this patent is extended or adjusted under 35 U.S.C. 154(b) by 291 days.

(21) Appl. No.: 12/468,677

(22) Filed: May 19, 2009

(51) Int. Cl.
*B66F 7/14* (2006.01)

(52) U.S. Cl. ..... 254/122; 254/126

(58) Field of Classification Search ..... 254/122–126
See application file for complete search history.

(56) References Cited

U.S. PATENT DOCUMENTS 4,653,727 A * 3/1987 Chang et al. ..... 254/1
4,749,169 A * 6/1988 Pickles ..... 254/122
4,872,230 A 10/1989 Levine
4,969,631 A 11/1990 Whittingham
5,085,407 A 2/1992 Lonon
5,657,964 A * 8/1997 Yoshida ..... 254/126
5,771,516 A * 6/1998 Huang ..... 7/100
6,237,953 B1 5/2001 Farmer
6,695,289 B1 * 2/2004 Mickael ..... 254/122
6,910,677 B1 * 6/2005 Miller et al. ..... 254/126
7,159,849 B2 * 1/2007 Raynor ..... 254/126
7,472,889 B1 * 1/2009 Prather ..... 254/103

* cited by examiner

*Primary Examiner* — Lee D Wilson
(74) *Attorney, Agent, or Firm* — Crossley Patent Law; Mark A. Crossley

(57) ABSTRACT

The electric scissor jack apparatus uses electrical power to elevate an automobile with a cigar lighter plug of an auto to power the high torque electric motor of the apparatus. The motor is in communication with the scissor jack via the gear reduction member so that maximum torque is applied to the scissor jack. Of significant importance is that the fail-safe coupling between the gear reduction drive and the scissor jack ensures against excessive or premature wear, failure, and danger to an operator. By avoiding any jack encasement, the apparatus provides for inexpensive multiple jack size utilization in that various sizes of scissor jacks are optionally fitted to the coupling housing of the gear reduction member.

3 Claims, 6 Drawing Sheets

ELECTRIC SCISSOR JACK APPARATUS

BACKGROUND OF THE INVENTION

Due to the difficulty of operating automobile jacks, various forms of electric jacks have been proffered. With the development of such electric jacks has gradually come an understanding of some of the problems associated therewith. Due to the torque needed to lift something as heavy as most automobiles, direct drive electric motors are not reliable; therefore, reduction gear drive mechanisms of some sort should be employed, as a severe mechanical advantage must be utilized. Direct motor-to-jack drive, with only two gears, fails to accomplish this task. Electric jacks that are built into an automobile have not been accepted due to expense and the need to at least lift each side of an auto, if not all corners individually. If a system is chosen to individually lift each corner of the auto, even greater expense in design, production, and cost is encountered. Some have even entertained total encasement of a scissor jack type device.

Such an approach is flawed due to constraints in production of many sizes of jacks and encasements, as scissor jacks are designed for a particular loads and therefore vary in size. An additional failing of the designs that propose electrically driven, gear reduction jacks is the failure to properly design the coupling between the jack and the gear drive. Significant loads are placed upon such couplings, and failure can be catastrophic in terms of mechanical damage and risk of human injury. The present apparatus successfully solves the problems associated with electrically driven automobile jacks.

FIELD OF THE INVENTION

The electric scissor jack apparatus relates to electric automotive jacks and more especially to an electric scissor jack with gear reduction drive and a unique coupling between reduction drive and jack.

SUMMARY OF THE INVENTION

The general purpose of the electric scissor jack apparatus, described subsequently in greater detail, is to provide a electric scissor jack apparatus which has many novel features that result in an improved electric scissor jack apparatus which is not anticipated, rendered obvious, suggested, or even implied by prior art, either alone or in combination thereof.

To attain this, the portable electric scissor jack apparatus uses electrical power to elevate an automobile. The ideal embodiment uses a cigar lighter plug of an auto to power the high torque electric motor of the apparatus, however, converters for wall outlet power are optionally provided. The motor is in communication with the scissor jack via the gear reduction member so that maximum torque is applied to the scissor jack. Of significant importance is that the fail-safe coupling between the gear reduction drive and the scissor jack ensures against excessive or premature wear, failure, and danger to an operator. By avoiding any jack encasement, the apparatus provides for inexpensive multiple jack size utilization in that various sizes of scissor jacks are optionally fitted to the coupling housing of the gear reduction member, without the expense of having to also produce multiple sizes of encasements.

Thus has been broadly outlined the more important features of the improved electric scissor jack apparatus so that the detailed description thereof that follows may be better understood and in order that the present contribution to the art may be better appreciated.

An object of the electric scissor jack apparatus is to use electrical power to elevate an automobile.

Another object of the electric scissor jack apparatus is to incorporate a scissor jack in electrically elevating an automobile.

An added object of the electric scissor jack apparatus is to employ gear reduction drive between the motor and the scissor jack.

A further object of the electric scissor jack apparatus is to ensure a fail-safe coupling between the gear reduction drive and the scissor jack.

And, an object of the electric scissor jack apparatus is to gain electrical power for the electric motor from an automobile.

Yet another object of the electric scissor jack apparatus is to provide for inexpensive multiple jack size utilization without a motor and gear reduction member change.

A further object of the electric scissor jack apparatus is to be portable.

These together with additional objects, features and advantages of the improved electric scissor jack apparatus will be readily apparent to those of ordinary skill in the art upon reading the following detailed description of presently preferred, but nonetheless illustrative, embodiments of the improved electric scissor jack apparatus when taken in conjunction with the accompanying drawings.

In this respect, before explaining the current embodiments of the improved electric scissor jack apparatus in detail, it is to be understood that the electric scissor jack apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved electric scissor jack apparatus. It is therefore important that the claims be regarded as including such equivalent constructions insofar as they do not depart from the spirit and scope of the electric scissor jack apparatus.

It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 6 thereof, the principles and concepts of the electric scissor jack apparatus generally designated by the reference number 10 will be described.

Figure 1:
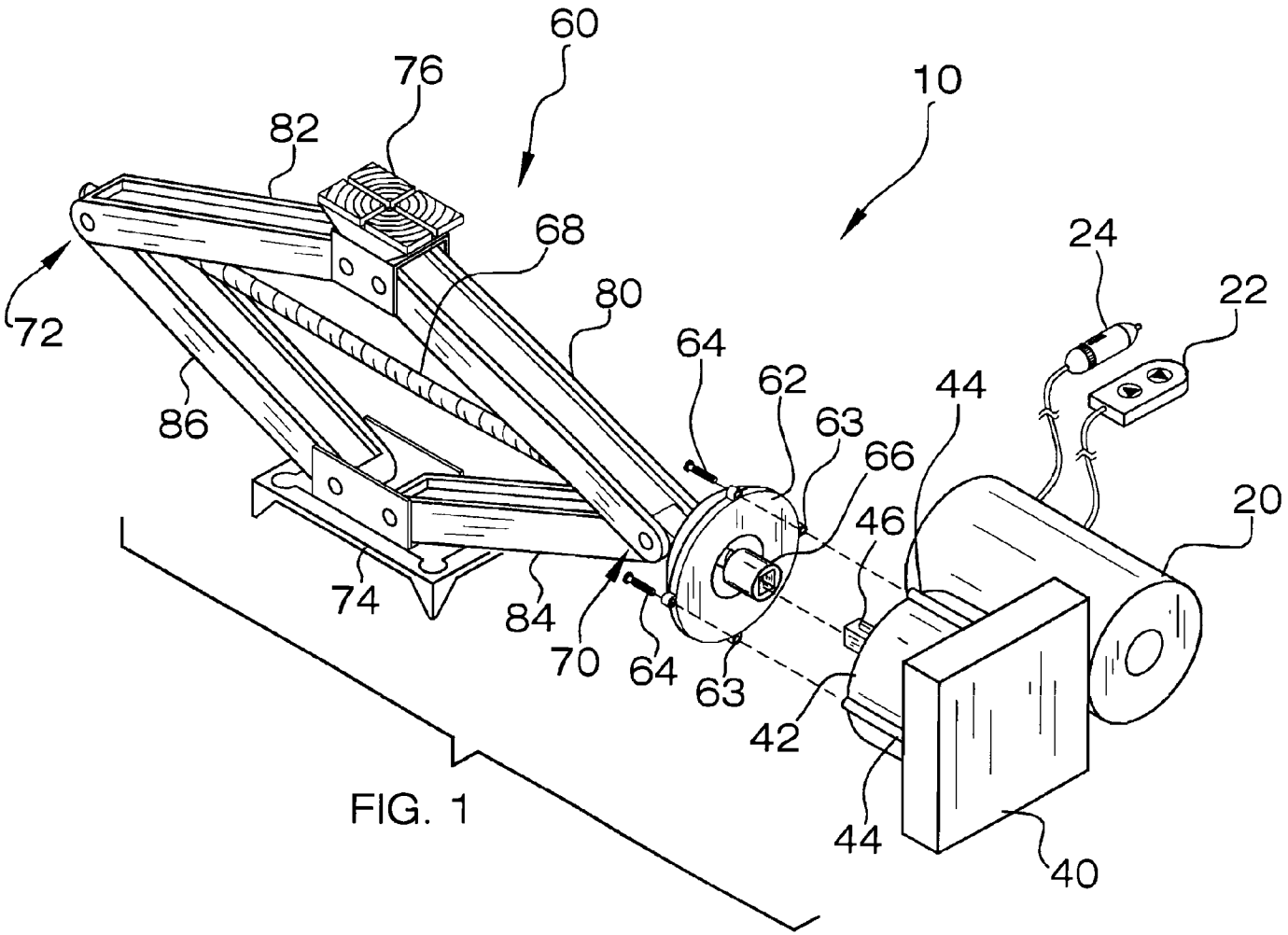
FIG. 1 is a perspective view, partially exploded.
Figure 2:
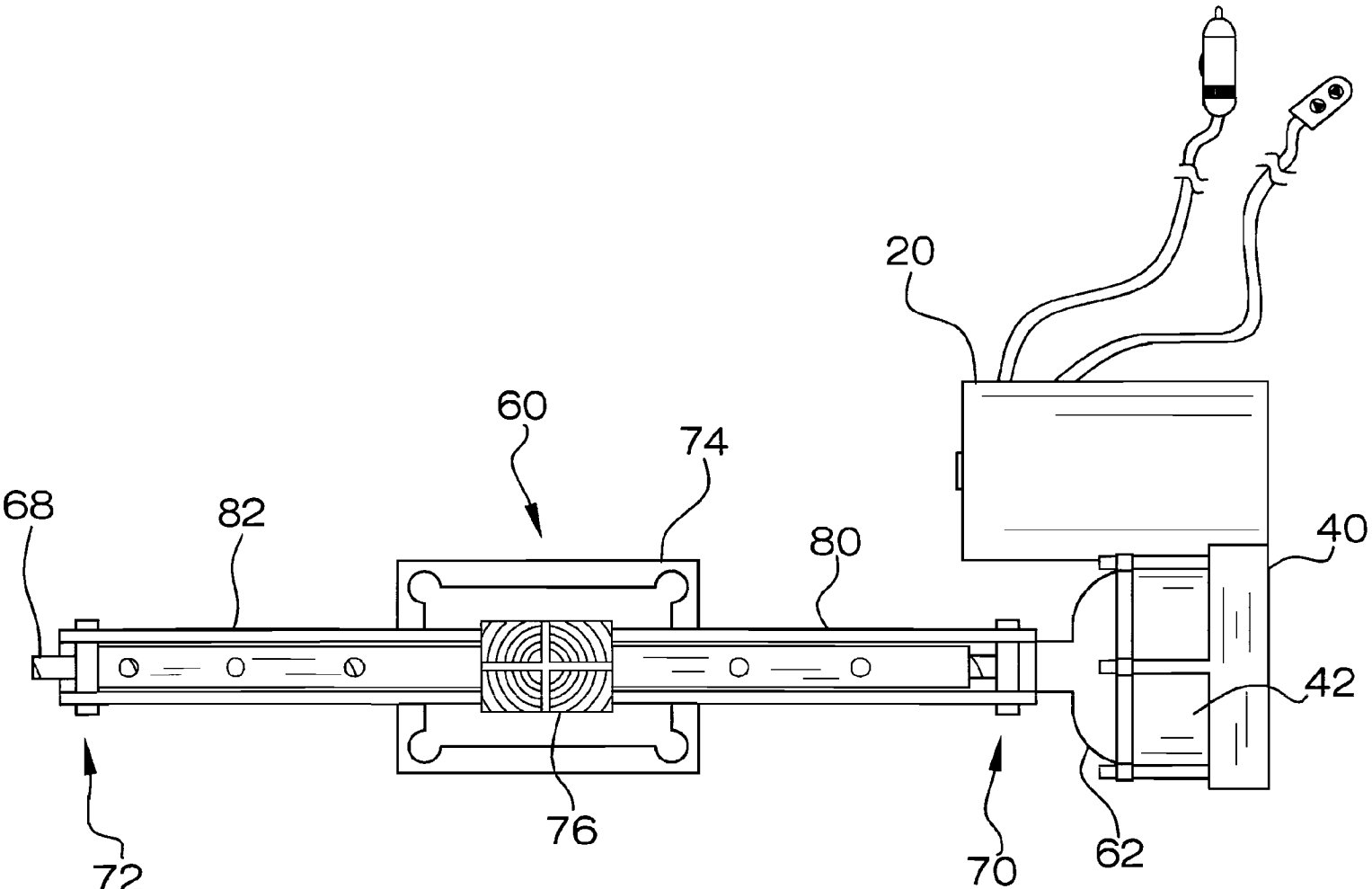
FIG. 2 is a top plan view.

Referring to FIGS. 1 and 2, the portable apparatus 10 partially comprises the high torque electric motor 20. The motor 20 is provided with a remote control 22 for both convenience and safety, so that a user need not be next to an automobile during lift or lowering. The electric power source for the motor 20 is ideally the cigar lighter plug 24. The gear reduction member 40 is mated directly to the motor 20.

Figure 3:
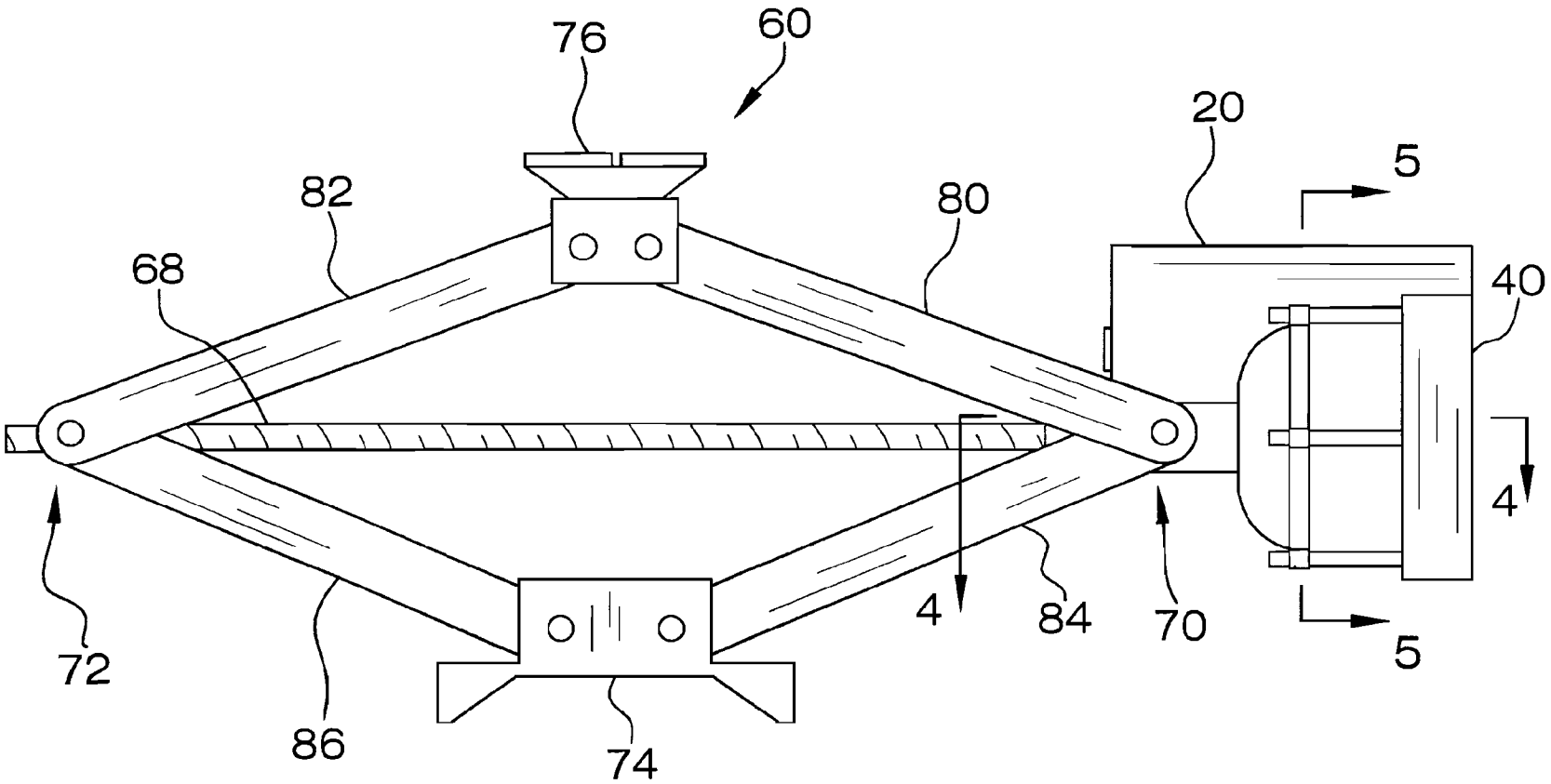
FIG. 3 is a lateral elevation view.

Referring again to FIG. 1 and also FIG. 3, the motor 20 is laterally adjacent to the gear reduction member 40.

Figure 4:
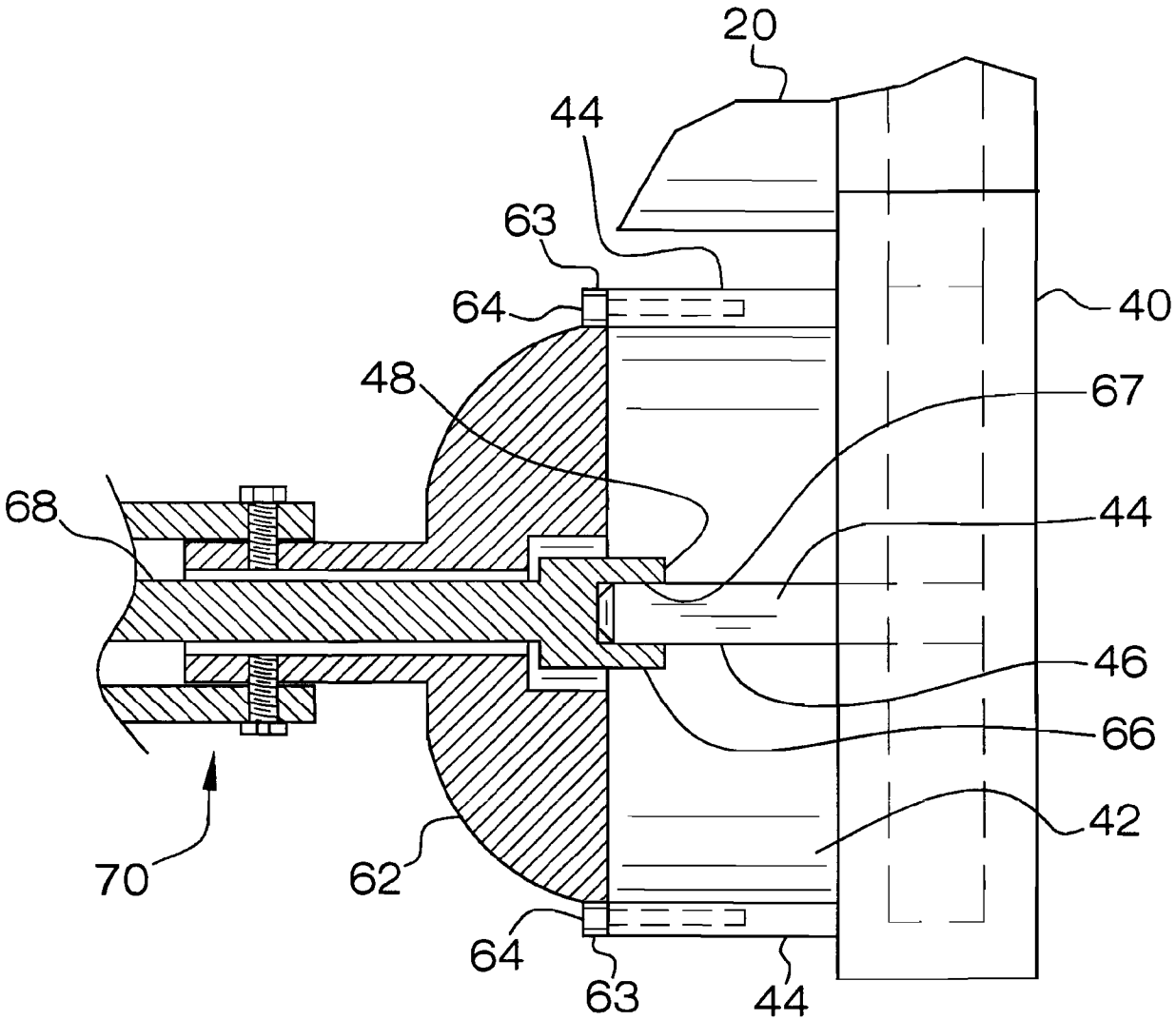
FIG. 4 is a top cross sectional view of the coupling housing and coupling mate of FIG. 3, taken along the line 4-4.

Referring again to FIG. 2 and also to FIG. 4, the coupling housing 42 is mated to the gear reduction member 40. The horizontally disposed cylindrical coupling housing 42 further comprises a plurality of equidistantly spaced apart horizontally disposed elongated female threaded coupling ears 44. The ears 44 are integral to the coupling housing 42. The coupling housing 42 further comprises the centrally disposed drive orifice 48. The square male drive 46 is rotatably partially extended from the drive orifice 48. The square male drive 46 is driven by the gear reduction member 40.

Referring again to FIGS. 3 and 4, the scissor jack 60 is attached to the coupling housing 42. The solid semispherical coupling mate 62 of the scissor jack 60 has a diameter equal to the coupling housing 42 diameter. The coupling mate 62 is affixed to the coupling housing 42 via the plurality of equidistantly spaced apart mount ears 63. The mount ears 63 are aligned with the coupling housing 42 coupling ears 44. The plurality of bolts 64 fastens the mount ears 63 to the coupling ears 44.

Figure 5:
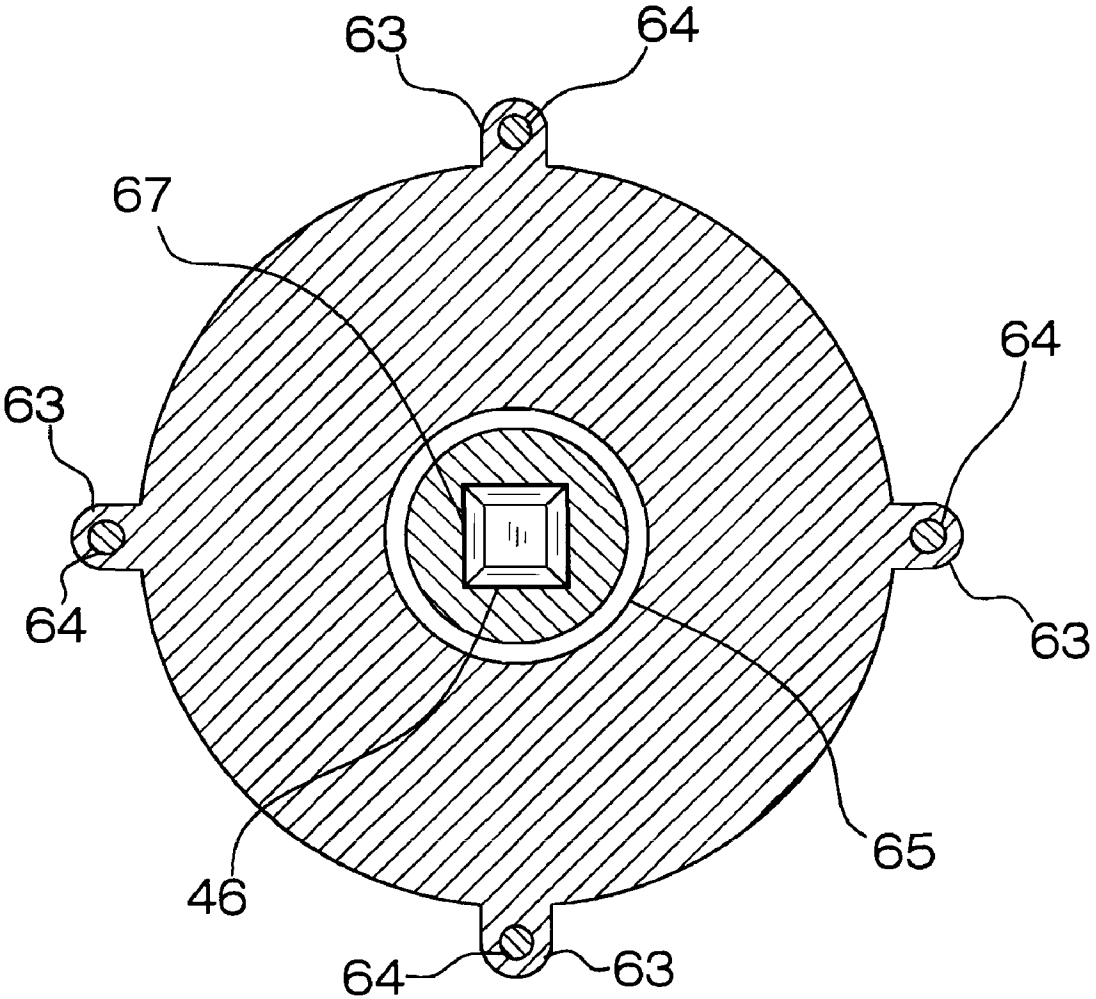
FIG. 5 is a frontal cross sectional view of the coupling mate of FIG. 3, taken along the line 5-5.

Continuing to refer to FIG. 4 and also referring to FIG. 5, the mate orifice 65 is centrally disposed in the semispherical coupling mate 62. The female drive 66 with square orifice 67 is partially extended from the mate orifice 65. The female drive 66 is rotatably fitted within the coupling housing 42 drive orifice 48.

Referring to FIG. 5 and continuing to refer to FIG. 4, the square orifice 67 is fitted to the square male drive 46 in a positive non-wobbling fit. The square male drive 46 has a diameter of at least ½ inch. The female drive 66 square orifice 67 matches that diameter. Larger diameter square male drives 46 and matching female drives 66 are available. The importance of the coupling between the gear reduction 40 coupling housing 42 with square male drive 46 and the coupling mate 62 with female drive 66 cannot be overstated. The screw drive 68 is extended from the female drive 66.

Referring again to FIGS. 2 and 3, the first pivot 70 is spaced apart from the second pivot 72. The pivots are movable toward and away from each other by the screw drive 68, a scissor jack 60 feature well known in the art. The scissor jack 60 further comprises the base 74 having a pair of pivotally affixed identical spaced apart lower arms. The lower arms comprise the first lower arm 84 affixed to the first pivot 70 and the second lower arm 86 affixed to the second pivot 72. The scissor jack 60 further comprises the lift block 76 having a pair of pivotally affixed identical spaced apart upper arms comprising the first upper arm 80 affixed to the first pivot 70 and the second upper arm 82 affixed to the second pivot 72.

Figure 6:
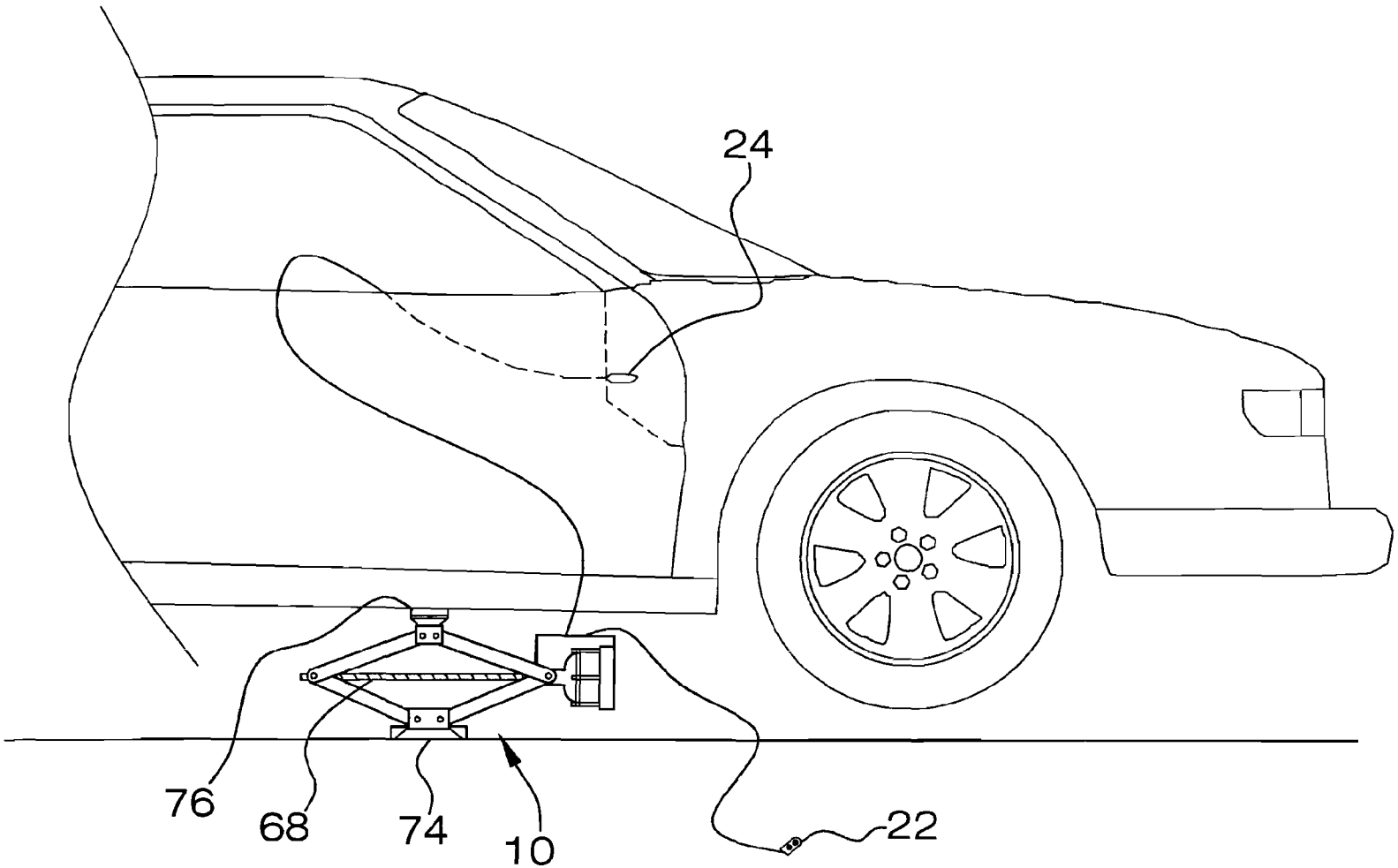
FIG. 6 is a lateral plan view of the apparatus in use lifting an automobile.

Referring to FIG. 6, clockwise rotation of the screw drive 68 draws the first pivot 70 and second pivot 72 together to bring the pivot arms into a more vertical than horizontal position, thereby elevating the lift block 76 in relation to the base 74. Conversely, counterclockwise rotation of the screw drive 68 spreads the first pivot 70 and second pivot 72, moving the pivot arms gradually into a more horizontal position, thereby bringing the lift block 76 closer to the base 74, and consequently lowering an automobile.

With respect to the above description then, it is to be realized that the optimum dimensional relationships for the parts of the electric scissor jack apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the electric scissor jack apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the electric scissor jack apparatus may be used.

Therefore, the foregoing is considered as illustrative only of the principles of the electric scissor jack apparatus. Further, since numerous modifications and changes will readily occur to those skilled in the art, it is not desired to limit the electric scissor jack apparatus to the exact construction and operation shown and described, and accordingly, all suitable modifications and equivalents may be resorted to, falling within the scope of the electric scissor jack apparatus.

What is claimed is:

1. A portable electric scissor jack apparatus, comprising, in combination:

a high torque electric motor;

an electrical power source for the motor;

a remote control controlling the motor;

a gear reduction member mated to the motor;

a horizontally disposed cylindrical coupling housing mated to the gear reduction member, the coupling housing having a diameter, the coupling housing further comprising:

a plurality of equidistantly spaced apart horizontally disposed elongated female threaded coupling ears;

a centrally disposed drive orifice;

a square male drive rotatably partially extended from the drive orifice, the square male drive driven by the gear reduction member;

a scissor jack attached to the coupling housing, the scissor jack comprising:

a solid semispherical coupling mate having a diameter equal to the coupling housing diameter, the coupling mate affixed to the coupling housing via a plurality of mount ears, the mount ears aligned with the coupling housing coupling ears;

a plurality of bolts fastening the mount ears to the coupling ears;

a mate orifice centrally disposed in the semispherical coupling mate;

a female drive with square orifice partially extended from the mate orifice, the female drive rotatably fitted within the coupling housing drive orifice, the square orifice fitted to the square male drive;

a screw drive extended from the female drive;

a first pivot spaced apart from a second pivot, the pivots movable toward and away from each other by the screw drive;

a base having a pair of pivotally affixed identical spaced apart lower arms comprising a first lower arm affixed to the first pivot, a second lower arm affixed to the second pivot;

a lift block having a pair of pivotally affixed identical spaced apart upper arms comprising a first upper arm affixed to the first pivot, a second upper arm affixed to the second pivot.

2. The apparatus according to claim 1 wherein the coupling housing elongated coupling ears are further integrally formed;

the coupling mate mount ears are integrally formed.

3. The apparatus according to claim 1 wherein the square male drive further comprises a diameter of at least ½ inch;

the female drive square orifice diameter comprises at least ½ inch.

* * * * *